US008346110B2

(12) United States Patent
Ariizumi

(10) Patent No.: US 8,346,110 B2
(45) Date of Patent: Jan. 1, 2013

(54) IMAGE FORMING APPARATUS

(75) Inventor: Osamu Ariizumi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 337 days.

(21) Appl. No.: 12/859,359

(22) Filed: Aug. 19, 2010

(65) Prior Publication Data

US 2011/0052219 A1 Mar. 3, 2011

(30) Foreign Application Priority Data

Aug. 27, 2009 (JP) ..... 2009-196561
Jun. 24, 2010 (JP) ..... 2010-143552

(51) Int. Cl.
*G03G 15/06* (2006.01)

(52) U.S. Cl. ..... 399/55; 399/50; 399/98; 399/127; 399/128; 399/129; 399/169

(58) Field of Classification Search ..... 399/50, 399/55, 98, 127, 128, 129, 169
See application file for complete search history.

(56) References Cited

U.S. PATENT DOCUMENTS

| | | | | |
|---|---|---|---|---|
| 6,330,405 | B1 | 12/2001 | Ishii et al. | |
| 7,260,345 | B2 | 8/2007 | Kamiya | |
| 7,751,733 | B2 * | 7/2010 | Sako et al. | 399/45 |
| 2002/0067404 | A1 * | 6/2002 | Loce | 399/51 |
| 2006/0051115 | A1 | 3/2006 | Kamiya | |

FOREIGN PATENT DOCUMENTS

| | | | |
|---|---|---|---|
| JP | 2004-333709 | A | 11/2004 |
| JP | 2009-186568 | A | 8/2009 |

* cited by examiner

*Primary Examiner* — Ryan Walsh
(74) *Attorney, Agent, or Firm* — Fitzpatrick, Cella, Harper & Scinto

(57) ABSTRACT

The image forming apparatus includes a photosensitive drum capable of bearing an electrostatic image, a development device having a developing sleeve capable of bearing a developer and a developer container capable of storing a magnetic toner, and a CPU controlling operation to discharge a developer having polarity opposite to a normally charged polarity to the photosensitive drum by enlarging a restoration electric field to force the developer having a normally charged polarity from the photosensitive drum to the development sleeve during image forming is not performed compared to that during normal image forming is performed, based on a weighted value (p×K) on an edge portion pixel number p of an edge portion of an output image.

5 Claims, 7 Drawing Sheets

FIG. 5

| | | FOG | | | DROPPING (TONER SPLASHING) | | |
|---|---|---|---|---|---|---|---|
| EDGE PORTION RATE [%] | SHEET-PASSING NUMBER ($\times 10^3$ SHEETS) [K sheet] | FIRST CONVENTIONAL CONDITION | SECOND CONVENTIONAL CONDITION | FIRST EMBODIMENT | FIRST CONVENTIONAL CONDITION | SECOND CONVENTIONAL CONDITION | SECOND CONVENTIONAL CONDITION |
| 0 | 0 | 0.2 | 0.2 | 0.2 | ○ | ○ | ○ |
| 30 | 5 | 0.2 | 0.2 | 0.3 | ○ | ○ | ○ |
| 50 | 10 | 0.5 | 0.2 | 0.3 | ○ | ○ | ○ |
| 100 | 15 | 1 | 0.4 | 0.4 | ○ | ○ | ○ |
| 0 | 20 | 0.9 | 0.2 | 0.3 | ○ | ○ | ○ |
| 30 | 25 | 1.1 | 0.4 | 0.4 | ○ | ○ | ○ |
| 50 | 30 | 1.5 | 0.4 | 0.5 | ○ | × | ○ |
| 100 | 35 | 2.1 | 0.6 | 0.6 | ○ | × | ○ |
| 0 | 40 | 1.8 | 0.2 | 2.1 | ○ | × | ○ |
| 30 | 45 | 2.1 | 0.4 | 2.4 | ○ | × | ○ |
| 50 | 50 | 2.4 | 0.6 | 2.6 | ○ | × | ○ |
| 100 | 55 | 2.9 | 0.6 | 2.9 | ○ | × | ○ |

IMAGE FORMING APPARATUS

BACKGROUND OF THE INVENTION

1. Field of the Invention

The present invention relates to an image forming apparatus having an image bearing member and a development device to utilize magnetic toner for development from a developer bearing member to the image bearing member.

2. Description of the Related Art

In the related art, an image forming apparatus of an electrophotographic system has been known. In such an image forming apparatus, an exposure device irradiates light to an image bearing member to write an electrostatic image on the surface of the image bearing member after a primary charging device evenly charges the surface of the image bearing member. Then, a magnetic toner is utilized for development from a developer bearing member to the image bearing member. The magnetic toner utilized for development is transferred to a sheet by a transfer device, and then, the sheet is separated from the image bearing member. The magnetic toner is fixed on the sheet by applying heat and pressure by the fixing device to the sheet having the magnetic toner transferred.

When magnetic toner is utilized for development from the abovementioned developer bearing member to the image bearing member, the following phenomenon has been an issue. That is, there may be a case that a magnetic toner having opposite-polarity appears on a non-image portion of the electrostatic image with development while an image portion of the electrostatic image is developed with a normal magnetic toner. A possibility of fog occurrence due to a magnetic toner having opposite-polarity has been an issue. Japanese Patent Application Laid-Open No. 2004-333709 discusses an invention to suppress fog caused by a magnetic toner having opposite-polarity.

According to an image forming apparatus of the invention discussed in Japanese Patent Application Laid-Open No. 2004-333709, it is possible to discharge a magnetic toner having opposite-polarity by changing direct-current voltage applied to the developer bearing member from that during normal image forming. With this configuration, roughening, density decrease and fog due to selective development are suppressed and an excellent image can be formed while keeping a lifetime of the image bearing member without changing toner composition and body structure.

However, there may be a possibility that a magnetic toner is excessively consumed as a whole as a magnetic toner having opposite-polarity is frequently and excessively discharged. Further proceeding, there may be a possibility that the image forming apparatus is broken due to splashing of the magnetic toner at the vicinity of a developer container.

The present invention provides an image forming apparatus capable of suppressing excessive consumption of a magnetic toner for reducing fog occurrence on an output image.

SUMMARY OF THE INVENTION

According to an aspect of the present invention, there is provided an image forming apparatus including an image bearing member capable of bearing an electrostatic image, a development device which includes a developer bearing member to bear a developer and which develops an electrostatic image on the image bearing member, and a controller which controls discharge operation to discharge a developer having polarity opposite to normally charged polarity to the image bearing member by enlarging a restoration electric field to force a developer having normally charged polarity from the image bearing member to the developer bearing member during image forming is not performed compared to that during normal image forming is performed, wherein the controller controls the discharge operation based on at least information corresponding to an edge portion of an output image.

Further features of the present invention will become apparent from the following description of exemplary embodiments with reference to the attached drawings.

BRIEF DESCRIPTION OF THE DRAWINGS

FIG. 5 is a graph indicating test results of the first embodiment;

DESCRIPTION OF THE EMBODIMENTS

In the following, exemplary embodiments of the present invention will be described in detail in an exemplified manner. Here, dimensions, materials, shapes and relative arrangement of the structural components described in the following embodiments are to be appropriately changed according to a configuration adopted to the present invention and various conditions. Accordingly, unless otherwise specified, the embodiments are not to be understood to limit the present invention thereto.

[First Embodiment]

Figure 1:
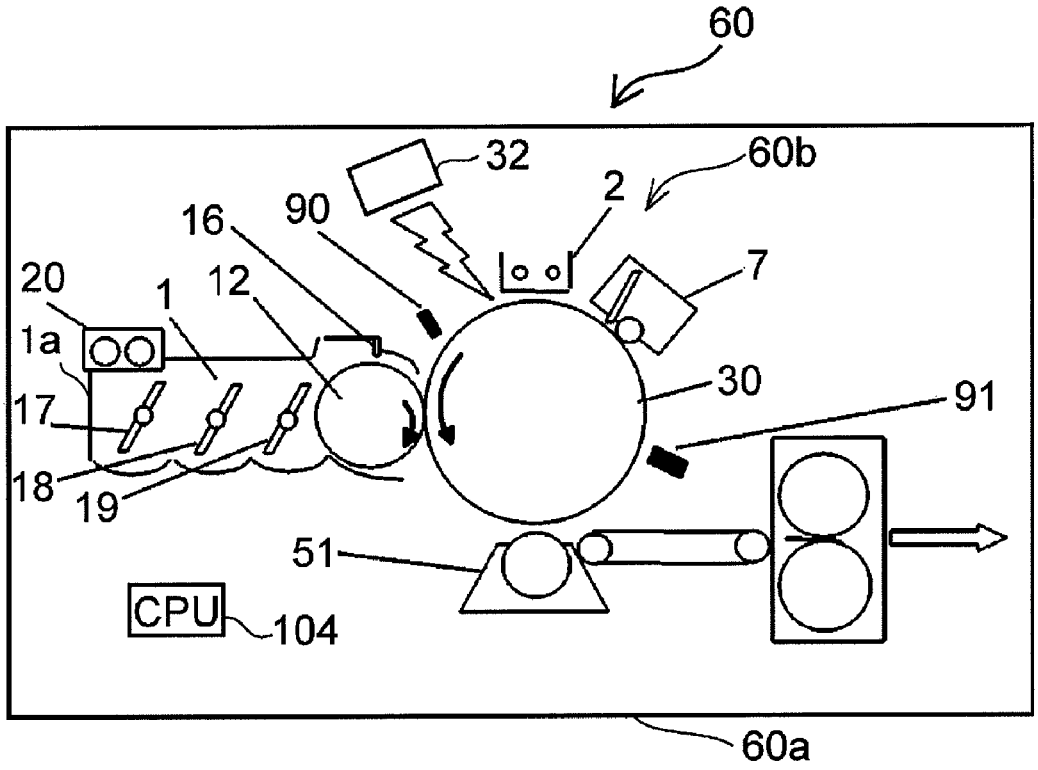
FIG. 1 is a sectional view illustrating the configuration of an image forming apparatus according to a first embodiment of the present invention.

FIG. 1 is a sectional view illustrating the configuration of an image forming apparatus 60 according to the first embodiment of the present invention. The image forming apparatus 60 is an image forming apparatus having a duplex printing function utilizing an electrophotographic image forming process. As illustrated in FIG. 1, the image forming apparatus 60 includes an image forming apparatus body (hereinafter, merely called an apparatus body) 60*a*. An image forming portion 60*b* to form an image on a sheet is arranged at the inside of the apparatus body 60*a*. The image forming portion 60*b* includes a photosensitive drum 30 as an image bearing member capable of bearing an electrostatic image, a primary charger 2 as primary charging device, an exposure device 32, a development device 1 and a transfer device 51. The primary charger 2, the exposure device 32, the development device 1, the transfer device 51 and a cleaning device 7 are arranged around the photosensitive drum 30.

The image forming apparatus 60 is a monochrome digital copying machine with capacity of 75 sheets per minute at a process speed of 350 mm/s. Image forming is performed as follows. First, the photosensitive drum 30 as the image bearing member is rotated and the surface of the photosensitive drum 30 is evenly charged by the primary charger 2. Next, the exposure device 32 performs exposure with a light emitting element (not illustrated) such as laser corresponding to an information signal, so that an electrostatic image is formed on the surface of the photosensitive drum 30. An a-Si photosensitive member having the diameter of 84 mm is utilized as the photosensitive member. The a-Si photosensitive member is more durable (i.e. lifetime of 500 million sheets) than an organic photosensitive member and is suitable for a high-speed machine for office use.

The development device 1 includes a developer container 1*a* capable of storing a magnetic toner in addition to a developing sleeve 12 capable of bearing a developer. The abovementioned electrostatic image is visualized as a toner image by being normally developed with the developer of a thin layer borne on the surface of the single developing sleeve 12 as a developer bearing member of the development device 1. The details of the developing device 1 will be described below.

For example, the image forming apparatus 60 adopts a magnetic toner being easy for handling not requiring maintenance operation until a million sheets of a developing sleeve lifetime. The magnetic toner is, for example, negative electric having a weight average grain diameter of approximately 6.8 μm.

For example, the weight average grain diameter is measured by the Multisizer (a registered trademark, manufactured by Coulter Corporation) utilizing ISOTON R-II (a registered trademark, manufactured by Coulter Scientific Japan Co.) as a solution. The measurement method is as follows. A surface-active agent of 0.1 to 5 ml is added into an electrolytic solution of 100 to 150 ml as a dispersant, and then, a measurement sample of 2 to 20 mg is added thereto. A dispersion process is performed for approximately 1 to 3 minutes on the electrolytic solution having the sample suspended with an ultrasonic dispersing machine. Then, the volume and number are measured by the abovementioned measuring equipment and the weight average grain diameter is calculated. When the weight average grain diameter is larger than 6.0 μm, grains of 2 to 60 μm are measured with an aperture of 100 μm. When the weight average grain diameter is between 3.0 and 6.0 μm inclusive, grains of 1 to 30 μm are measured with an aperture of 50 μm. When the weight average grain diameter is smaller than 3.0 μm, grains of 0.6 to 18 μm are measured with an aperture of 30 μm.

As described above, the development device 1 includes the developing sleeve 12. The developing sleeve. 12 is a cylinder-shaped rotating member which is arranged at an opening part of the developing device 1 to store a magnetic toner being opposed to the photosensitive drum 30 along the longitudinal direction of the photosensitive drum 30 as being adjacent thereto. A thin layer forming member 16 (as width is 10 mm and thickness is 1.6 mm) made of SPCC is arranged at the opening part of the developing device 1 above the developing sleeve 12 as being adjacent to the surface of the developing sleeve 12 having a gap distance of 200 μm. Then, a thin layer of a developer is formed by restricting thickness thereof at the surface of the developing sleeve 12.

The mass m1 per unit area of the thin layer developer is 0.9 mg/cm$^2$. Measurement of the mass m1 per unit area is performed as collecting a developer by a vacuum, measuring a mass M (mg) of the collected developer, calculating area S (cm$^2$) of a developer vacuumed zone at the surface of the developing sleeve 12, and dividing M by S.

Three blade-shaped agitating members 17, 18, and 19 to agitate and convey the stored toner are arranged at the inside of the development device 1. The toner is conveyed to the vicinity of the developing sleeve 12 side by rotation of the agitating members 17, 18, and 19.

A toner replenishment container 20 is arranged at the upper part of the development device 1. A toner is replenished to the inside of the development device 1 from the toner replenishment container 20 based on toner residual quantity information detected by a toner residual quantity detection sensor (not illustrated).

The developing sleeve 12 is rotated in the forward direction against the photosensitive drum 30. Specifically, when the magnetic toner borne at the surface of the developing sleeve 12 is flown (i.e., conveyed) to the photosensitive drum 30 side, the developing sleeve 12 is rotated in the rotation direction of a flying magnetic toner from the developing sleeve 12 as following to the rotation of the photosensitive drum 30, that is, the direction of the arrow in FIG. 1. The developing sleeve 12 is a metal pipe having the outer diameter of 24.5 mm and is rotated 1.44 times faster than the photosensitive drum 30 (i.e., 504 mm/sec). A fixed magnet is arranged as being fixed to the inside of the developing sleeve 12.

During development operation, a development electric field is generated at the developing sleeve 12 by superimposing and applying +300 V as DC bias and a rectangular wave having 1200 V of peak-to-peak voltage and 2.7 kHz of frequency as AC bias. A toner image is obtained by flying the toner layer on the surface of the developing sleeve 12 to the electrostatic image on the surface of the photosensitive drum 30. At that time, development contrast is 200 V and fog-elimination contrast is 100 V.

In the first embodiment, the image forming apparatus 60 adopts background area exposure (BAE) to form an image forming potential by exposing a non-image area on the photosensitive drum 30 when forming an electrostatic image. The image forming apparatus 60 includes a potential sensor 90 to detect a potential at the surface of the photosensitive drum 30 and a light detection sensor 91 to detect a potential at the surface of the photosensitive drum 30 after developing arranged around the photosensitive drum 30. Further, the image forming apparatus 60 includes a CPU 104 as a controller to control devices at the inside of the apparatus main body 60*a*.

Figure 2:
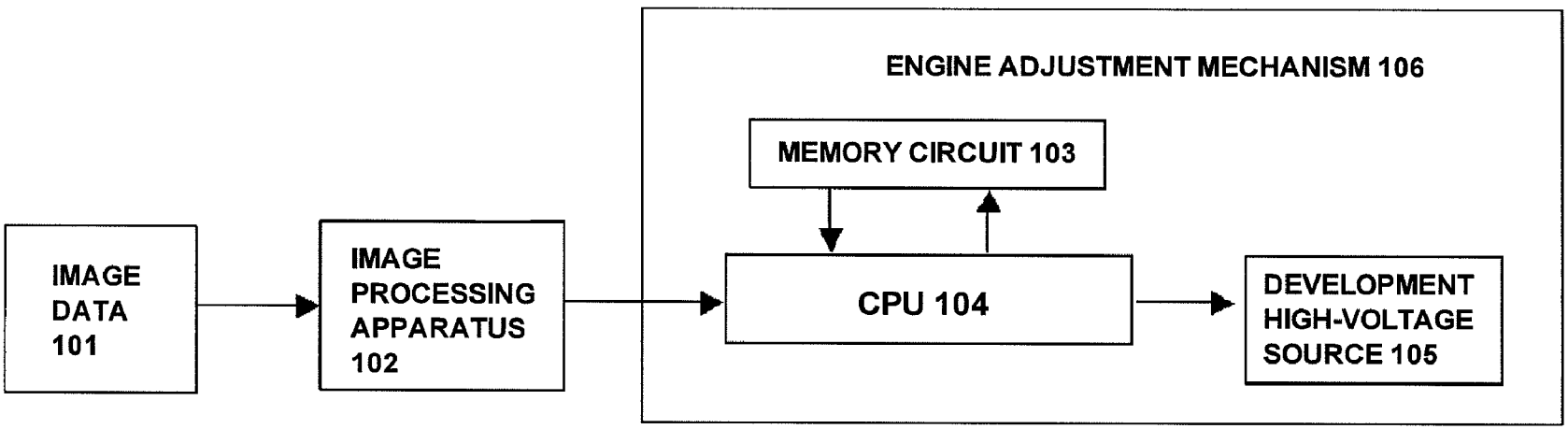
FIG. 2 is a conceptual diagram illustrating a transmission state of image data with which an image is formed by the image forming apparatus.

FIG. 2 is a conceptual diagram illustrating a transmission state of image data 101 with which an image is formed by the image forming apparatus 60. As illustrated in FIG. 2, the image data 101 is transmitted to an image processing apparatus 102. In the image processing apparatus 102, an area of an edge portion of an output image is detected based on the image data 101.

An engine adjustment mechanism 106 is arranged following to the image processing apparatus 102. The engine adjustment mechanism 106 includes the CPU 104 as the controller, a memory circuit 103 and a development high-voltage source 105. The obtained information of the edge portion area is stored in the memory circuit 103 as edge quantity of the output image. In the first embodiment, execution of discharging a magnetic toner is determined based on the edge quantity of the image area. That is, the control is performed so that discharge frequency (i.e., discharge quantity) of an opposite-polarity toner in the case of a large edge quantity is higher than that in the case of a small edge quantity. The discharge quantity can be appropriately adjusted by changing a discharge area and electric field strength during discharging. Accordingly, in the case of outputting an image with less edge portions, performing of toner discharge more than necessary is suppressed by lowering the discharge frequency. Since discharged toner is often weakly charged, toner discharge more than necessary causes toner splashing and increase of unnecessary down-time.

The CPU 104 varies image forming conditions against the photosensitive drum 30 based on the image data 101. Further, the CPU 104 calculates the sum value by summing at least a weighted value on image information quantity of edge portions of an output image and a value of image information quantity of portions other than the edge portions of the output image. Further, in the case that the sum value is equal to or larger than a predetermined value, the CPU 104 applies an electric field during image forming is not performed being larger than a restoration electric field formed during normal image forming is performed, between the photosensitive drum 30 and the developing sleeve 12. Here, the restoration electric field denotes an electric field where a toner of normally charged polarity receives force in the direction from the photosensitive drum 30 to the developing sleeve 12. An example of the above is described in the following. When the exposure device 32 exposes the photosensitive drum 30, an image area having an image (i.e., an electrostatic image) formed and a non-image area having an image (i.e., an electrostatic image) not formed are generated on the surface of the photosensitive drum 30. The image area includes an image portion having a minus toner attached at the same potential without being exposed and a non-image portion having a minus toner not attached with a decreased potential by being exposed. When the image area of the photosensitive drum 30 passes a close position to the developing sleeve 12 (i.e., corresponds to the timing of image forming), the potential at the image portion (i.e., a black part in a picture) is to be +500 V and the potential at the non-image portion (i.e., a void part in a picture) is to be +200 V at the surface of the photosensitive drum 30. At that time, the potential at the surface of the developing sleeve 12 is to be +300 V. The developing sleeve 12 is attached with a minus toner (i.e., normally charged polarity toner) having a minus potential and a plus toner (i.e., opposite-polarity toner) having a plus potential. Then, due to the development contrast, the minus toner (i.e., normally charged polarity toner) is moved from the developing sleeve 12 to the photosensitive drum 30, and at the same time, the residual rate of the plus toner (i.e., opposite-polarity toner) at the surface of the developing sleeve 12 is increased. In order to suppress increase of the plus toner, the CPU 104 sets the potential at the non-image area of the photosensitive drum 30 to be 0 V and the potential of the surface of the developing sleeve 12 to be +600 V when the non-image area passes the close position to the developing sleeve 12 (i.e., corresponds to the timing of non-image forming). In this manner, the restoration electric field to force a minus toner from the photosensitive drum 30 to the developing sleeve 12 is set to be 600 V as being larger than 100 V of the restoration electric field during normal image forming. Accordingly, the plus toner is moved as being discharged from the developing sleeve 12 to the photosensitive drum 30. In particular, the CPU 104 sets the discharge frequency of plus toner (i.e., opposite-polarity toner) to be higher or discharge quantity thereof per one time to be more for the image having more edge portions of the output image.

In the case that consumption of the magnetic toner developed from the developing sleeve 12 to the photosensitive drum 30 is less than a predetermined value, the CPU 104 applies the restoration electric field during image forming is not performed being similar to that during normal image forming is performed, between the photosensitive drum 30 and the developing sleeve 12. Here, the term during image forming is not performed includes timing of preparation operation (i.e., timing of previous-rotation) performed before image forming after receiving a print signal and timing of preparation operation (i.e., timing of after-rotation) performed after image forming. In addition, the term includes image forming intervals of respective recording materials (i.e., so-called inter-sheets) during continuous image forming. In the above example, the CPU 104 sets the surface potential at the non-image area of the surface of the photosensitive drum 30 to be +200 V and the surface potential of the developing sleeve 12 to be +300 V during image forming is not performed.

The above operation of the CPU 104 is based on the following reasons. The electrostatic image on the surface of the photosensitive drum 30 is formed by charge exposure for image forming. A strong electric field is generated at the edge portions including a corner part and a line part of the electrostatic image due to the edge effect of an electric field. Accordingly, the magnetic toner having large charge quantity is selectively attracted to the surface of the photosensitive drum 30 at the edge portions of the output image. As a result, the magnetic toner having large charge quantity is more apt to be consumed with an output image having more edge portions compared to the case with an output image having less edge portions, so that the magnetic toner having small charge quantity is to be remained. On the other hand, when outputting an output image having less edge portions, the magnetic toner charged in opposite-polarity is not to be rapidly increased within the developer container 1*a* since both of the magnetic toner having small charge quantity and the magnetic toner having large charge quantity are to be consumed. The CPU 104 utilizes the above characteristics.

Figure 3:
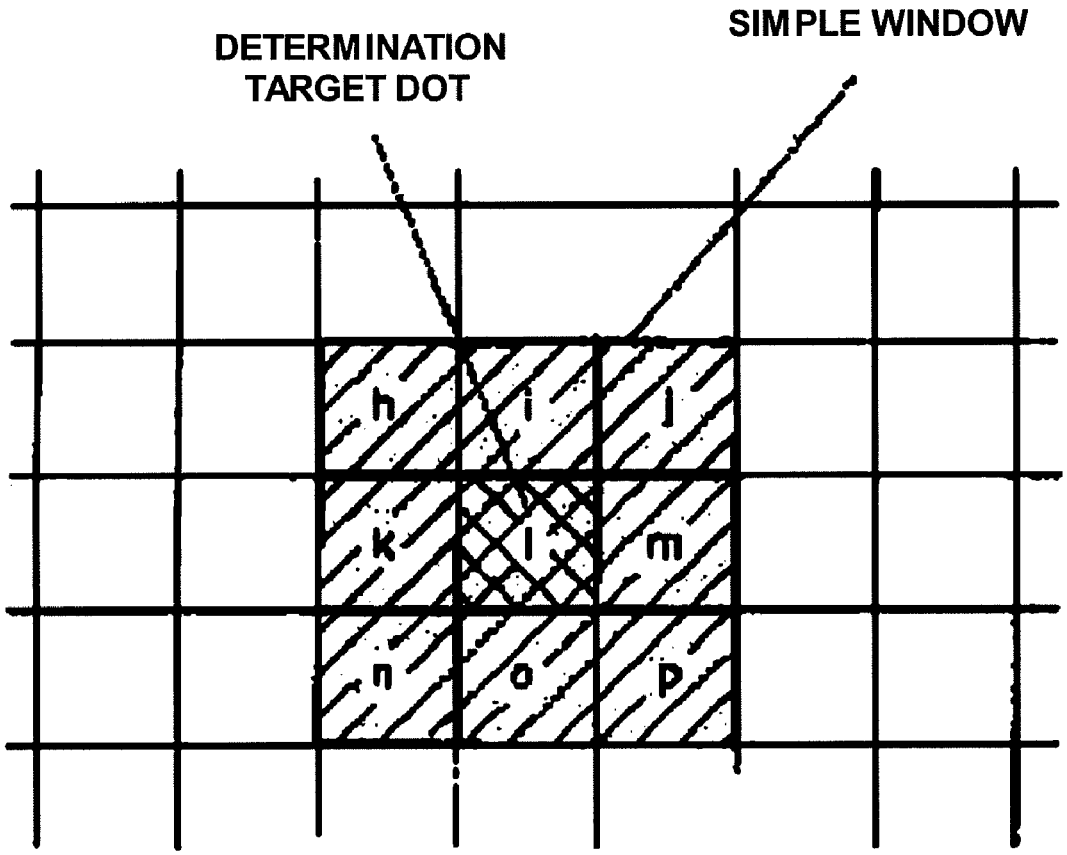
FIG. 3 is a conceptual diagram illustrating image data indicated in a matrix.

FIG. 3 is a conceptual diagram illustrating image data indicated in a matrix. In the following, an edge detection method adopted in the first embodiment will be described in detail with reference to FIG. 3. A matrix of 3×3 dots having a determination target dot to be a determination target at the center thereof (i.e., a sample window) is focused in an original image of binary data. A method to perform logical multiplication among l, i, m, k and o is adopted as a determination method as l denotes data of the determination target dot and i, k, m and o respectively denote data of dots on the left, right, top and bottom of the determination target dot data l.

When the result of the logical multiplication is "1", the determination target dot is an internal dot without including an edge. When the multiplication result is "0" and the determination target dot is "1", the determination target dot is an edge. Here, not limited to the 3×3 dots matrix, an enlarged matrix of x×x dots (x is an arbitrary integer) can be utilized.

Figure 4:
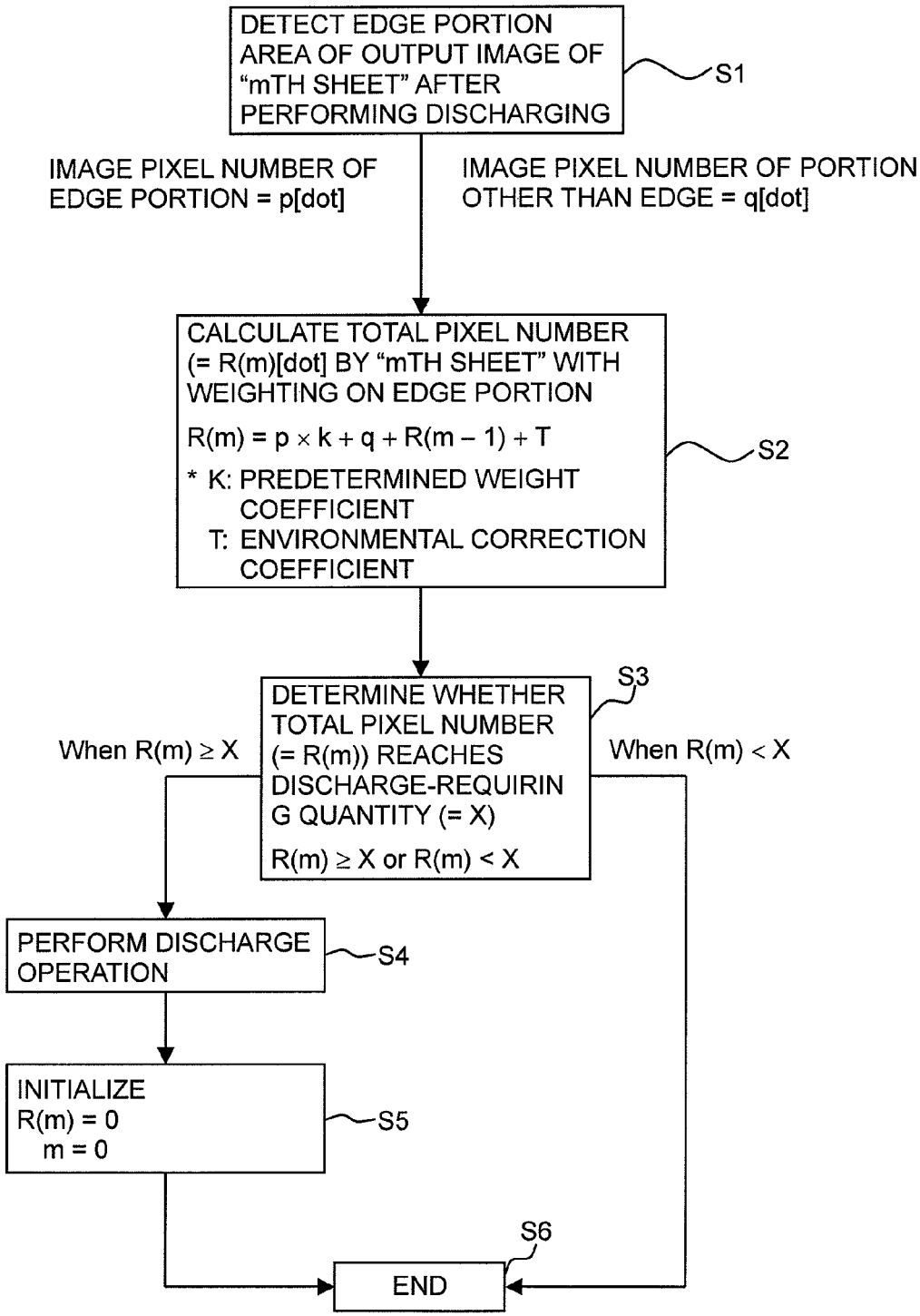
FIG. 4 is a flowchart illustrating control processes of a controller.

FIG. 4 is a flowchart illustrating control processes of the CPU 104. As illustrated in FIG. 4, the CPU 104 discharges a magnetic toner. First, the CPU 104 obtains information of an edge portions pixel number p (dots) of the edge portions and an other portion pixel number q (dots) of portions other than the edge portions with the edge detection function based on input image data (step 1, hereinafter, "step" is abbreviated to merely "S" as S1).

The CPU 104 performs weighting calculation on the edge pixel number p of the pixel portion, as expressed with the following equation 1. That is, the CPU 104 performs weighting by multiplying the edge pixel number p by a weight coefficient K (K>1), so that a pixel number (p×K) is calculated as "a weighted value against image information quantity of the edge portions". With this process, when images having the same printing rate are output, the discharge frequency of the opposite-polarity toner for an image having more edge portions is to be higher than that for an image having less edge portions. The CPU 104 adds the other portion pixel number q as "image information quantity of portions other than the edge portions" to the pixel number (p×K), and then, further adds a calculated total pixel number R(m−1) at the time of m−1 sheets thereto. Then, the CPU 104 calculates a calculated total pixel number R(m) (dots) at the time of m sheets after performing discharge operation of the magnetic toner (S2). Since toner charge characteristics vary due to a mechanical environment, an environment correction coefficient T is added corresponding to the environment when calculating the calculated total pixel number R(m). The value of the environment correction coefficient T is necessary to be set corresponding to a toner to be used. Here, since the increase of the magnetic toner charged in opposite-polarity affects more than the environment variation, the environment correction coefficient T is treated as zero in the first embodiment. Naturally, it is also possible to separately assign a set value to the environment correction coefficient T or to set parameter therefor. In this manner, the calculated total pixel number R(m) as the abovementioned sum value includes a value added thereto or subtracted therefrom by the environment correction coefficient T as the correction coefficient so as to be appropriately adjusted by the environment correction coefficient T.

[Equation 1]

$$R(m)=p\times K+q+R(m-1)+T \quad (1)$$

The CPU 104 determines whether the calculated total pixel number R(m) calculated as described above reaches the quantity to require discharging. Here, the CPU 104 determines whether the calculated total pixel number R(m) exceeds a discharge requiring pixel number X (S3). Then, when the calculated total pixel number R(m) is equal to or more than the discharge requiring pixel number X, the CPU 104 determines that discharge operation is required. Meanwhile, when the calculated total pixel number R(m) is less than the discharge requiring pixel number X, the CPU 104 determines that the consumption does not reach the level to require discharging (S3). When it is determined that the discharge operation is required to be performed, the CPU 104 performs the discharge operation (S4). After the discharge operation is performed, the CPU 104 performs initializing of the sheet number m and the calculated total pixel number R(m) (S5). Then, the CPU 104 terminates the discharge control of the magnetic toner (S6). Meanwhile, when the CPU 104 determines that the consumption does not reach the level to require discharging, the CPU 104 terminates the discharge control of the magnetic toner (S6). Here, it is also possible to adjust the abovementioned discharge frequency of the opposite-polarity toner by determining the value of the discharge requiring pixel number X in the process S3, for example. That is, when the value of the discharge requiring pixel number X is decreased, the discharge frequency of opposite-polarity toner becomes high. When the value of the discharge requiring pixel number X is increased, the discharge frequency of the opposite-polarity toner becomes low.

As described in S4 of FIG. 4, when the CPU 104 determines that the magnetic toner is required to be discharged, the CPU 104 controls to change the development bias, so that the magnetic toner is discharged. That is, in order to discharge the magnetic toner charged in opposite-polarity, the CPU 104 applies the electric field during image forming is not performed being larger than the electric field formed during normal image forming is performed. In the first embodiment, the potential at the surface of the photosensitive drum 30 is set to be 0 V and the potential at the surface of the developing sleeve 12 is set to be 600 V. Accordingly, voltage of 600 V is applied between the photosensitive drum 30 and the developing sleeve 12. Then, the magnetic toner charged in opposite-polarity being a plus side is moved from the developing sleeve 12 to the photosensitive drum 30. In this manner, the magnetic toner charged in opposite-polarity is reduced from the inside of the developer container 1*a*, so that development characteristics can be maintained. On the contrary, when the CPU 104 determines that the magnetic toner is not required to be discharged, the CPU 104 applies the restoration electric field during image forming is not performed being similar to that during normal image forming is performed, between the photosensitive drum 30 and the developing sleeve 12. In the following, an evaluation result with time on fog fluctuation and toner dirt at the inside of the apparatus body 60*a* will be described in comparison between with and without adopting control technology of the CPU 104 of the first embodiment.

The printing test of the image forming apparatus 60 of the first embodiment is performed in the condition that the sheet-passing number is 55000 sheets (as A4 size) and the image area rate is 6%. Then, as the sheet-passing condition, one JOB is set to a hundred sheet repetition and the JOB is repeated. In the test of this time, test results are compared between conventional conditions and the present embodiment.

Two patterns are set as the conventional conditions. That is, the first conventional condition set by an operator is to perform discharging every thousand sheet-passing and the second conventional condition is to perform discharging every hundred sheet-passing. The evaluation with time is performed by the operator as performing sheet-passing sequentially with four kinds of images. In either of the first conventional condition and the second conventional condition, the image area rate of an image against an output sheet is kept constant at 6% and outputting is performed as varying ratio between characters and solid portions. The character ratio is prepared from 0% (i.e., without a character) to 100% (i.e., only characters) by the operator.

In the processes of the flowchart of FIG. 4, the first embodiment has settings of the weight coefficient K being 3 and the discharge requiring pixel number X being $2000\times10^6$ [dpi]. With operation of the image forming apparatus 60 of FIG. 1 based on the above set conditions, the operator checks fog on the sheets and toner dirt with time. Here, fog is measured with a fog density measuring instrument. When a measurement value is large, it is determined that fog occurs. When the fog measurement value of the measured result exceeds 1, visible level of fog occurs and determined to be an NG level. Further, toner splashing is evaluated with OK or NG where a splashed toner is attached to an image of a passing sheet (i.e., dropping).

FIG. 5 is a graph indicating the test results of the first embodiment. As indicated in FIG. 5, in the test results of this time, the first conventional condition brought a good result in dropping (i.e., toner splashing) of the magnetic toner with time but a bad result in fogging of the magnetic toner with time. Meanwhile, the second conventional condition brought good result in fogging of the magnetic toner with time but a bad result in dropping (i.e., toner splashing) of the magnetic toner with time, since discharge intervals of the magnetic toner were shortened. The condition of the first embodiment brought good results in both fogging and dropping of the magnetic toner with time. Accordingly, detecting edge portions as the first embodiment enables to actualize a system to suppress fogging and dropping with time.

[Second Embodiment]

Figure 6:
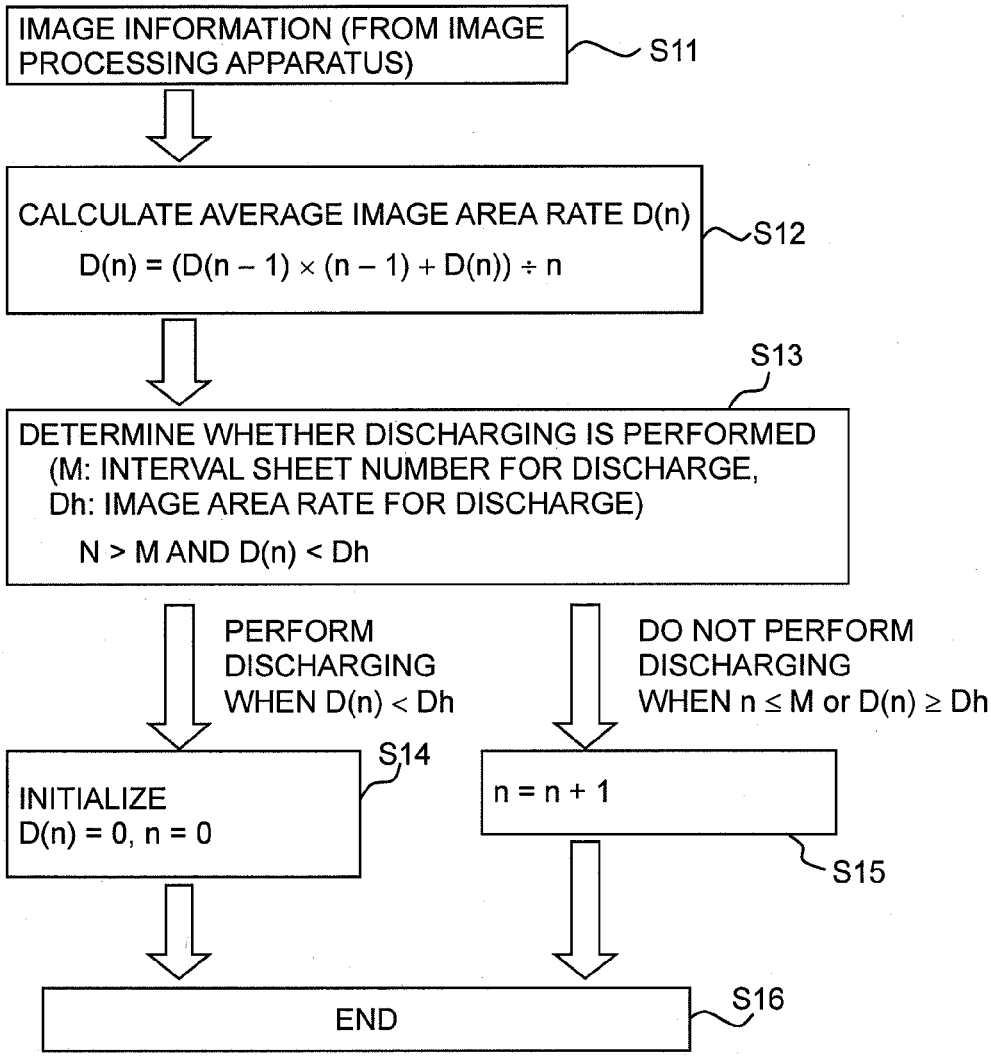
FIG. 6 is a flowchart illustrating control processes of a controller of an image forming apparatus according to a second embodiment.

FIG. 6 is a flowchart illustrating control processes of the CPU 104 of an image forming apparatus of the second embodiment. Description of structures and effects of the image forming apparatus of the second embodiment being same as those of the first embodiment will not be repeated appropriately by utilizing same numerals. In the first embodiment, discharge of the magnetic toner is performed to discharge the magnetic toner charged in opposite-polarity when toner consumption is increased based on detection of edge portions of image data. Here, in the case that consumption of the magnetic toner is too small, image density of an output image is decreased since the magnetic toner is deteriorated because additives of the magnetic toner are buried therein, as described above. The image forming apparatus of the second embodiment is different from the image forming apparatus 60 of the first embodiment in the point that image density is maintained with time as the CPU 104 of the second embodiment performs to discharge the magnetic toner to prevent density decrease even when consumption of the magnetic toner is small.

In the second embodiment, the image forming apparatus having the same configuration as the image forming apparatus 60 of FIG. 1 is utilized, and the image processing apparatus 102 of FIG. 2 calculates the image area rate from a video-count value of an output image. Then, the image information of the calculated image area rate is to be sequentially accumulated in the memory circuit 103 (see FIG. 2). Subsequently, an accumulative image area rate is calculated at the memory circuit 103 and the CPU 104, and then, discharge operation of the magnetic toner is performed when the accumulative image area rate is lower than a predetermined value (see FIG. 2).

Next, the accumulative image area rate and performing of discharge operation of the magnetic toner will be described with reference to FIG. 6. As illustrated in FIG. 6, the CPU 104 receives image information from the image processing apparatus 102 (S11). The CPU 104 calculates an average image area rate D(n) after n sheets pass based on the following equation 2 (S12).

[Equation 2]

$$D(n)=(D(n-1)\times(n-1)+D(n))\div n \quad (2)$$

The CPU 104 determines whether discharge operation of the magnetic toner is performed corresponding to the calculated average image area rate (S13). For determining whether discharge operation of the magnetic toner is performed, a sheet-passing interval number until the magnetic toner discharging is performed is set as M and the image area rate of the magnetic toner is set as Dh. Then, the CPU 104 determines whether the sheet-passing number n is larger than the sheet-passing interval number M (S13). Further, in the case that the sheet-passing number n is larger than the sheet-passing interval number M, the CPU 104 determines whether the average image area rate D(n) is smaller than the image area rate for discharge Dh (S13).

In the case that the sheet-passing number n is larger than the sheet-passing interval number M and the average image area rate D(n) is smaller than the image area rate for discharge Dh, the CPU 104 performs discharge operation of the magnetic toner. That is, the CPU 104 determines that the consumption of the magnetic toner acquired by multiplying the average image area rate D(n) by the sheet-passing number n is too small. In the case that the sheet-passing number n is equal to or smaller than the sheet-passing interval number M or that the average image area rate D(n) is equal to or larger than the image area rate for discharge Dh, discharge operation of the magnetic toner is not performed. Here, the sheet-passing interval number M and the image area rate for discharge Dh are values being arbitrarily set in each image forming apparatus as being different with setting. In the second embodiment, M is set at 1000 sheets and Dh is set at 6%.

In the case that discharge operation of the magnetic toner is performed in S13 as described above, the sheet-passing number n is initialized (S14). In the case that the discharge operation of the magnetic toner is not performed in S13, the count number of the sheet-passing number n is incremented by one count to be n+1. (S15). The CPU 104 terminates control (S16) after controlling of S14 or S15.

For the discharging magnetic toner, the CPU 104 outputs solid black for a span of time corresponding to ten turns of the developing sleeve 12 during rotation after image forming, so that deteriorated toner at the vicinity of the developing sleeve 12 is discharged. Here, although the above operation is performed in the span of time corresponding to ten turns of the developing sleeve 12, the span of time may be arbitrarily set according to an image forming apparatus to be used. For example, the discharging time is set to be 1.3 seconds and the discharging of a deteriorated toner is discharged by outputting solid black for that time. The normal image forming condition described in the first embodiment is utilized for the bias condition for discharging. That is, as described above, the potential at the developing sleeve 12 is to be +300 V and the potential of the photosensitive drum 30 is to be +500 V. Accordingly, the surface of the photosensitive drum 30 is in the state of the image portion of the image area, that is, to be solid black.

Here, the operator performed evaluation with time in the condition of being with/without discharging of the magnetic toner of the second embodiment and checked variation of image density with time. As the conditions, the sheet-passing number is set to 50000 sheets (as A4 size) and the output image area rate is set to 1%. Then, as the sheet-passing condition, one JOB is set to a hundred sheet repetition and the JOB is repeated.

Figure 7:
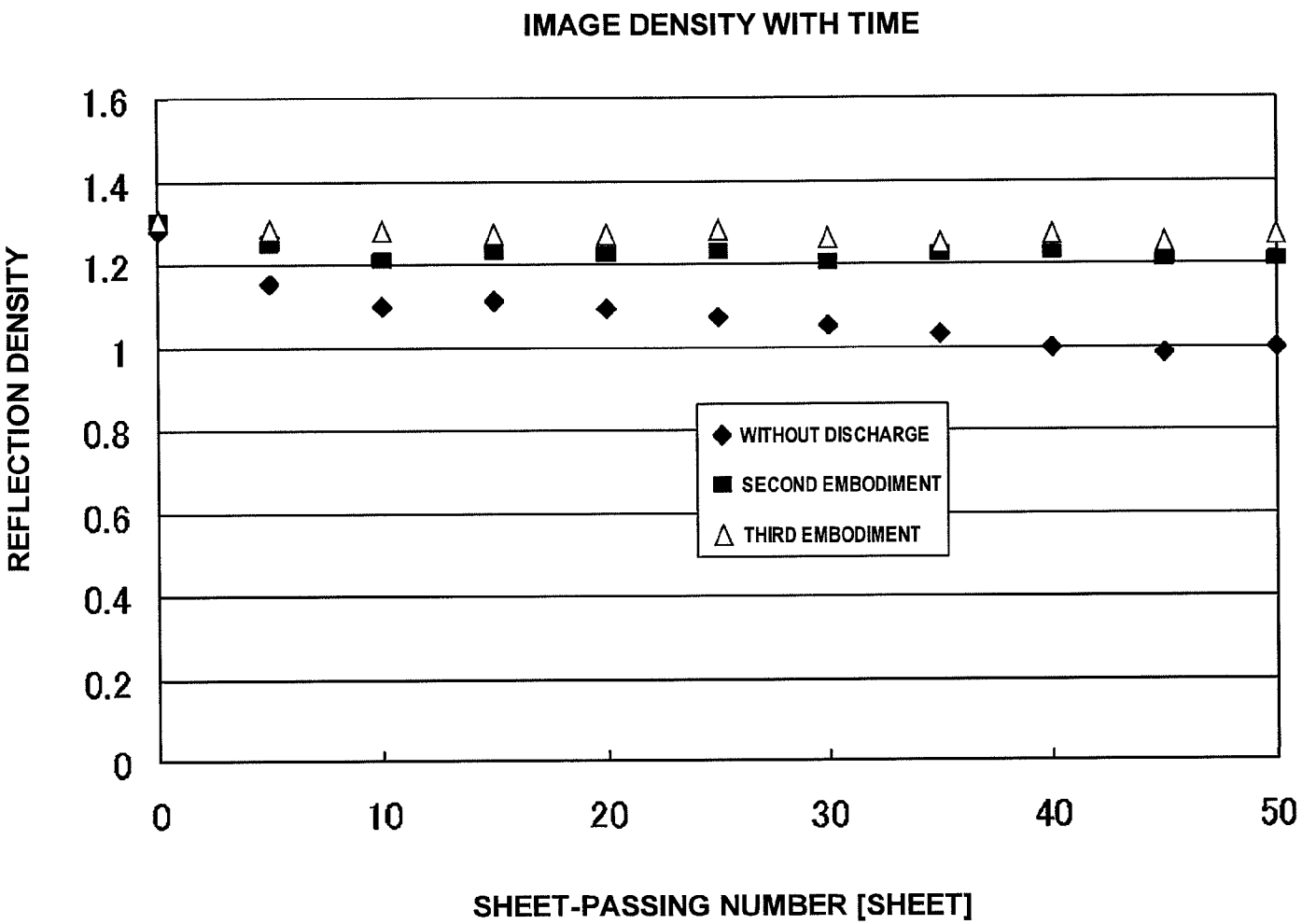
FIG. 7 is a graph indicating test results of the second embodiment and a third embodiment.

FIG. 7 is a graph indicating the test results of image density variation with time according to the second embodiment and the below-mentioned third embodiment. The horizontal axis denotes the sheet passing number ($\times 10^3$ sheets) of the evaluation with time and the vertical axis denotes reflection density of the output image thereat. The reflection density is measured with a reflection density measuring instrument manufactured by X-Rite Incorporated. FIG. 7 indicates that the image density is stabilized by performing discharge operation of the magnetic toner as the evaluation of the image density with time.

[Third Embodiment]

An image forming apparatus of a third embodiment is subject to the same structures and effects of the image forming apparatus of the second embodiment. In the first embodiment, since a magnetic toner is apt to be moved toward an electrostatic image corresponding to an edge portion of image data, the magnetic toner charged in opposite-polarity is discharged according to consumption of the magnetic toner corresponding to the edge portion of the image data. In this case, the magnetic toner is apt to be moved to the edge portion of the electrostatic image. In addition, there is a tendency that the toner quantity being moved is increased due to a strong electric field.

Then, in the third embodiment, the following operation is performed when calculating the consumption of the magnetic toner in the image processing apparatus 102 of FIG. 2 in the conditions of the second embodiment with utilizing the edge detection method used in the first embodiment. That is, the average image rate D(n) is calculated from the calculated total pixel number R(m) corresponding to "a total consumption pixel number" having weighted on the edge portions calculated in S2 of FIG. 4. Stability of the image density is promoted against the second embodiment by utilizing the above control process.

That is, based on the following equation 3, the average image area rate D(f) is calculated from the calculated total pixel number R(f) of the case that the total sheet number is f with utilizing resolution E and sheet area S per sheet. Here, pixel number per sheet is acquired by dividing the calculated total pixel number R(f) by the total sheet number f. Printing area per sheet is acquired by dividing the pixel number per sheet by the resolution E as pixel number per unit area. Then, the average image area rate D(f) is acquired by dividing the printing area per sheet by the sheet area S per sheet.

[Equation 3]

$$D(f)=[R(f)/f]\div E\div S \quad (3)$$

According to the image forming apparatuses of the first to third embodiments, the CPU 104 calculates the pixel number (p×K) as the weighted value on the edge portion pixel number p as "the image information quantity of edge portions" of the output image. Further, the CPU 104 adds the other portion pixel number q as "the image information quantity of portions other than the edge portions" of the output image to the pixel number (p×K). Further, the CPU 104 adds the calculated total pixel number R(m−1) of m−1 sheets and the environment correction coefficient T. In this manner, the CPU 104 calculates the calculated total pixel number R(m) of m sheets as the sum value by summing the abovementioned weighted value (p×K), the other portion pixel number q, the calculated total pixel number R(m−1) of m−1 sheets, and the environment correction coefficient T. In the case that the calculated total pixel number R(m) as the sum value is equal to or larger than the discharge requiring pixel number X as the predetermined value, the electric field being larger than that during normal image forming is performed is applied between the photosensitive drum 30 and the developing sleeve 12 during image forming is not performed. In the case of image data having large edge portion pixel number p as "the image information quantity of edge portions", there is a possibility that the magnetic toner having opposite-polarity rapidly increases within the developer container 1*a* due to development with the magnetic toner having normal-polarity. The CPU 104 suppresses the possibility. That is, the CPU 104 controls discharge operation to set the restoration electric field to force, from the photosensitive drum 30 to the developing sleeve 12, the magnetic toner having normally charged polarity during image forming is not performed to be larger than that during normal image forming is performed, at least based on the information corresponding to edge portions of the output image. Accordingly, the magnetic toner having opposite-polarity is moved more from the developing sleeve 12 to the photosensitive drum 30. With the above control, useless developing quantity of the magnetic toner having normal-polarity is reduced and discharge frequency of the magnetic toner having opposite-polarity is increased. As a result, excessive consumption of the magnetic toner can be suppressed for reducing fog occurring at the output image.

In the conventional art, when a toner having large charge quantity is selectively used for development, the low-charged toner having small charge quantity is to be accumulated within a development device with time. Meanwhile, in one component development, an opposite-polarity toner having polarity opposite to that of the toner used for development is mixed. When such opposite-polarity toner is increased with time within the development device due to development selectively with a toner having large charge quantity, the opposite-polarity toner appears as fog at an image blank portion during normal image outputting. As described above, there has been a tendency of increase of a toner having charged in low or in opposite-polarity within the development device as the toner is consumed with time.

According to the image forming apparatus of the second embodiment, the CPU 104 performs the following control in the case that the sheet-passing number n is larger than the sheet-passing interval number M and the average image area rate D(n)×n as the "consumption of a magnetic toner" is smaller than the image area rate for discharge Dh×n as the predetermined value. That is, even during image forming is not performed, the CPU 104 sets the surface potential of the photosensitive drum 30 to be the potential (i.e., +500 V) at the image portion during image forming is performed, and then, sets the surface potential of the developing sleeve 12 to be the potential (i.e., +300 V) during image forming is performed. In this manner, the electric field having the same polarity as that of the development electric field during image forming is performed at the non-image area based on image data is applied between the photosensitive drum 30 and the developing sleeve 12. Therefore, the magnetic toner is consumed before being deteriorated due to repetition of agitation and frictional charge. As a result, it is possible to suppress density decrease of the output image caused by the low-charged magnetic toner.

In the conventional art, there has been an issue that a toner is deteriorated even when toner consumption is small. This is because additives on the toner surface are buried into toner bodies due to repetition of agitation and frictional charge of a toner. When such as phenomenon occurs, flowability of the toner is decreased and frictional charge is unable to be performed. When flowability of the toner is decreased, quantity of the toner having appropriate charge quantity to be used for development is to be small. Finally, malfunction of density decrease of the output image occurs. That is, when the toner consumption is small, deterioration of toner is accelerated due to frequent repetition of agitation and frictional charge. Further, recently, in the tendency of speeding-up, additives are buried more easily into the toner due to temperature increase at the vicinity of a developing sleeve within the developer container and toner deterioration is more apt to occur within a developer container.

According to the image forming apparatuses of the first to third embodiments, there is not a possibility that a magnetic toner having opposite-polarity rapidly increases within the developing container 1*a* when image data has small image information quantity of edge portions. The CPU 104 calculates the calculated total pixel number R(m) of m sheets as the sum value acquired by summing at least the pixel number (p×K) as the value having weighted on the edge portion pixel number p of the output image, the other portion pixel number q of the output image, the calculated total pixel number R(m−1) of m−1 sheets, and the environment correction coefficient T. The CPU 104 performs the following control in the case that the calculated total pixel number R(m) of m sheets is less than the discharge requiring pixel number X as the predetermined value. That is, even during image forming is not performed, the CPU 104 sets the surface potential of the photosensitive drum 30 to be the potential (i.e., +200 V) at the non-image portion during image forming is performed, and then, sets the surface potential of the developing sleeve 12 to be the potential (i.e., +300 V) during image forming is performed. In this manner, the electric field having the same polarity as that of the development electric field during image forming is performed at the non-image area is applied between the photosensitive drum 30 and the developing sleeve 12. As a result, it is suppressed that the CPU 104 uselessly consumes the magnetic toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-196561, filed Aug. 27, 2009, No. 2010-143552, filed Jun. 24, 2010, which are hereby incorporated by reference herein in their entirety.

What is claimed is:

1. An image forming apparatus comprising:

an image bearing member capable of bearing an electrostatic image;

a development device that includes a developer bearing member which bears developer, the development device being configured to develop an electrostatic image corresponding to an output image on the image bearing member; and a controller configured to control a discharge operation of discharging a developer, which has a polarity opposite to a normal polarity, to the image bearing member by forming an electric field which is larger than when image formation is performed, wherein the electric field forces the developer having the opposite polarity from the developer bearing member to the image bearing member at a time when image formation is not performed, and wherein the controller is further configured to control the discharge operation based on at least information corresponding to an edge portion of an output image.

2. The image forming apparatus according to claim 1, wherein the controller controls the discharge operation such that in a case where a quantity of the edge portion of the output image is more than a predetermined quantity, frequency of the discharge operation is higher than a frequency of the discharge operation in a case where the quantity of the edge portion of the output image is less than the predetermined quantity.

3. The image forming apparatus according to claim 1, wherein the controller controls the discharge operation such that in a case where a quantity of the edge portion of an output image is more than a predetermined quantity, a discharge quantity during one discharge operation is higher than a discharge quantity during one discharge operation in a case where the quantity of the edge portion of the output image is less than the predetermined quantity.

4. The image forming apparatus according to claim 1, wherein the controller is further configured to control the discharge operation based on information of a portion of the output image other than the edge portion of the output image.

5. The image forming apparatus according to claim 1, wherein the controller is further configured to execute the discharge operation when a sum value acquired by summing (i) a value weighted on information of the edge portion of the output image and (ii) a value of information of a portion of the output image other than the edge portion of the output image, is equal to or larger than a predetermined value.

* * * * *